United States Patent [19]

Hirnböck et al.

[11] 4,383,701

[45] May 17, 1983

[54] SKI

[75] Inventors: Rudolf Hirnböck; Adolf Haudum, both of Hohenems, Austria

[73] Assignee: Kästle Gesellschaft m.b.H., Hohenems, Austria

[21] Appl. No.: 215,437

[22] Filed: Dec. 11, 1980

[30] Foreign Application Priority Data

Dec. 17, 1979 [AT] Austria ..... 7910/79

[51] Int. Cl.[3] ..... A63C 5/00

[52] U.S. Cl. ..... 280/610; 428/164; 428/194; 428/209

[58] Field of Search ..... 280/601, 610; 428/164, 428/192, 194, 209

[56] References Cited

U.S. PATENT DOCUMENTS 3,201,138 8/1965 Brown, Jr. ..... 280/610
3,329,437 7/1967 Holmberg et al. ..... 280/610
3,414,279 12/1968 Allain ..... 280/610

FOREIGN PATENT DOCUMENTS 296103 1/1972 Austria .
1703369 5/1968 Fed. Rep. of Germany .
2054952 5/1971 Fed. Rep. of Germany ..... 280/610

*Primary Examiner*—Joseph F. Peters, Jr.
*Assistant Examiner*—Michael Mar
*Attorney, Agent, or Firm*—Karl F. Ross; Herbert Dubno

[57] ABSTRACT

A ski with a ski body comprising a core, an upper and a lower reinforcing face, wherein at least one of the reinforcing faces comprises a profiled metal sheet having a U-shaped recess between lateral legs, the back of said recess being directed toward the core, and wherein strips of elastic-viscous material are arranged between the lateral legs of the profiled metal sheet and the core.

10 Claims, 2 Drawing Figures

SKI

FIELD OF THE INVENTION

This invention relates to a ski with a ski body comprising a core, an upper reinforcing face and a lower reinforcing face, and an elastic-viscous material arranged between said core and at least one of said reinforcing faces.

DESCRIPTION OF THE PRIOR ART

In the manufacture of skis, sheets made of elastic-viscous materials, e.g. of rubber or other elastomers, are used for vibration damping purposes in order to ensure smooth running of the ski. This is of particular importance for skiing on bumpy slopes and at high speeds.

OBJECT OF THE INVENTION

It is the object of the present invention to provide in respect of function, manufacture and profitability, favorable conditions for integrating sheets of elastic-viscous material into the body of a ski, especially an Alpine ski.

SUMMARY OF THE INVENTION

According to this invention, this is achieved in that at least one of the reinforcing faces comprises a profiled metal sheet having a U-shaped recess between lateral legs, the back of the recess being directed toward the core. The elastic-viscous material is disposed on the side of the lateral legs of said profiled sheet directed towards said core.

It has proved to be advantageous to arrange the elastic-viscous material in strips between the lateral legs of the profiled metal sheet and the core, preferably the breadth of said strips of elastic-viscous material being equal to the breadth of the lateral legs of the profiled metal sheet.

The present invention provides, depending on the dimension of the breadth and depth of the U-shaped recess of the profiled metal sheet, defined regions for receiving the elastic-viscous material, i.e. the regions between the lateral legs of the profiled metal sheet and the core, in which regions the elastic-viscous material is not excessively squeezed when the ski is being pressed. As a result, the vibration damping properties of the elastic-viscous material are fully effective. By appropriate dimensioning of the U-shaped recess in the profiled metal sheet, the sheets or strips of elastic-viscous material can be adapted to optimal thickness and breadth, thus, avoiding an overdimensioning of the sheets or strips of elastic-viscous material. An overdimensioning of the elastic-viscous sheets or strips would result in a fatigue of the compound structure of the ski body and would—in order to preserve a certain torsional rigidity of the ski—require an increase in the strength of the reinforcing faces, which would have an adverse effect on the cost of manufacture.

A shear stress is a prerequisite for exploiting the elastic-viscous properties of the strip. This is particularly the case with the arrangement of the elastic-viscous material according to this invention, as shear stress occurs in particular in the marginal zones of the joint between the reinforcing faces and the core. Hence, the stress peaks occuring along the contours of the ski can be reduced.

It has proved to be advantageous to adapt the elastic-viscous material to end freely at the side faces of the ski.

Hence, the elastic-viscous material is not enclosed at the edge of the ski, and good properties in respect of elastic deformation will be obtained.

The U-shaped recess of the profiled sheet is advantageously adapted to receive a filler sheet of solid material, e.g. of veneer wood, or preferably to receive a sheet of reinforced plastics. It is an advantage of the profiled sheets that the lateral rims of the sheet inserted into the U-shaped recess are protected by the flanks of the U. This is of particular importance if the sheet is made of reinforced plastics.

The profiled sheet may advantageously be of light metal, particularly of an aluminum alloy. Elastomers, e.g. rubber sheets or plasticized polyurethane, may be employed as elastic-viscous material (material of viscous elasticity).

SPECIFIC DESCRIPTION

Figure 1:
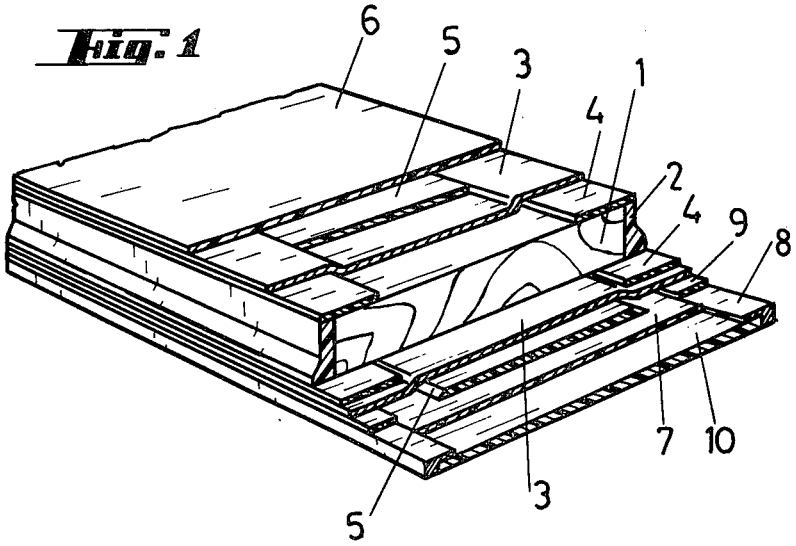
FIG. 1 is a schematic perspective view, partly in section, of one embodiment of an Alpine ski according to the invention

In the embodiment shown in FIG. 1 the ski body comprises a core 1 of wood with side walls 2 of phenolic resin. One profiled sheet 3, each of an aluminum alloy is arranged above and below the core 1. Damping strips 4 of elastic-viscous material are provided between the lateral legs of the profiled sheet 3 and the core 1. The thickness of the damping strips 4 corresponds to the depth of the U-shaped recesses in the profiled sheets 3. When the ski is compressed, the thickness of the damping strips 4 may be slightly reduced because of a minor deformation of the core surface.

A sheet 5 of glass fiber reinforced plastic, e.g. epoxy resin, is arranged in each of the U-shaped recesses of the profiled sheets 3 for reinforcement purposes. A cured laminate may be used however wet rovings, which are more economical and particularly suitable for the U-shaped recesses, can be laid in the profiled sheets 3. The thickness of the sheets 5 corresponds to the depth of the U-shaped recesses in the profiled sheets 3 so that the top sheet 6 of ABS-plastics (acrylonitrile—butadiene—styrene plastic) lies on a planar surface. The same is true for the lower levelling sheet 7 of wood veneer, which is arranged between the horizontal legs of the steel edges 8. The steel edges 8 are secured to the lateral legs of the lower profiled sheet 3 by means of strip-shaped sheets 9 of elastomer. The running base 10 of polyethylene is arranged between the flanges of the steel edges 8.

Depending on the construction of the ski tip and the rear end of the ski, the sheets illustrated in FIG. 1 extend substantially over the entire length of the ski. This is particularly the case with the profiled sheet 3 and the strips 4 of elastic-viscous material. The profiled sheets 3 can, however, also terminate in the portion of the ski shovel, i.e. change over into a flat non-profiled sheet. In the forward portion, the core 1 of the ski may—as is usually the case—terminate before the turnup of the shovel and in the rearward portion before the rear end of the ski, which is preferably also slightly turned up.

Figure 2:
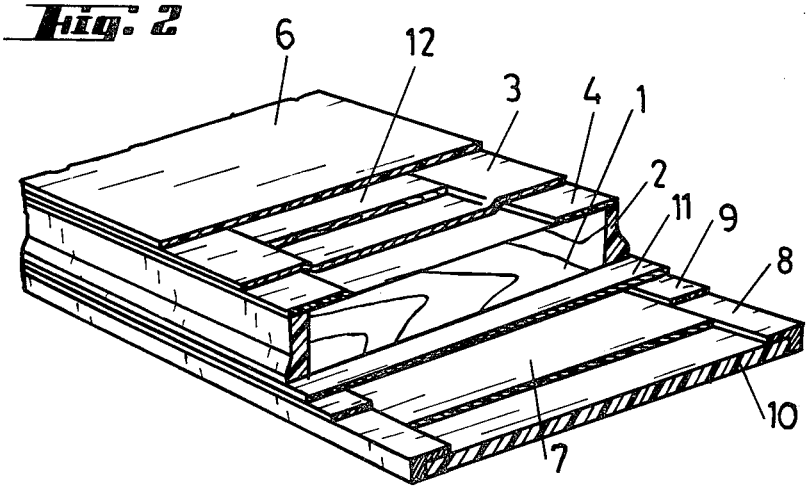
FIG. 2 is a similar view of a second embodiment of an Alpine ski according to the present invention.

In the embodiment illustrated in FIG. 2, the upper reinforcing face only is a profiled sheet 3, whereas the lower reinforcing sheet is a flat layer 11. The profiled sheet 3 as well as the layer 11 are made of an aluminium alloy. The damping strips 4 of elastic-viscous material are arranged between the core 1 of wood with the side walls 2 of phenolic resin and the lateral legs of the profiled sheet 3. A filler- or levelling sheet 12 of veneer is inserted into the U-shaped recess of the profiled sheet 3. The top of the cross-section of the ski is again formed by a sheet 6 of ABS-plastic. The steel edges 8, which are secured to the lamina 11 by means of the strip-shaped sheets 9 of elastomer, the levelling sheet 7 of wood veneer and the running base 10 of polyethylene are arranged below the 11. The lengths of the sheets are equal to those described in the embodiment illustrated in FIG. 1.

A number of variants of the illustrated embodiments are possible within the scope of the present invention. In FIG. 1, for example, the sheets 5 of glass fiber reinforced plastic may be replaced by mere filler sheets, e.g. of wood veneer, if no further reinforcement of the reinforcing faces is required in the specific ski model. Conversely, the filler sheet 12 shown in FIG. 2 may be replaced by a sheet of reinforced plastic inserted into the U-shaped recess of the profiled sheet 3. Moreover, in the embodiments illustrated in FIG. 1 as well as in FIG. 2, additional elastic-viscous material may be arranged in the U-shaped recess of the profiled sheet 3. In a further variant, the lower reinforcing face only is provided with a profile, whereas the upper reinforcing face is a flat sheet of metal and/or reinforced plastics material.

Other materials than described in the embodiments illustrated in FIGS. 1 and 2 may obviously also be used for the core 1, the side walls 2, the top sheet 6 and the running base 10. Foamed plastic material, for example, is particularly suitable for the core 1.

What is claimed is:

1. A ski comprising a ski body formed with a lower snow-engaging face and an upper face each formed by respective layers, a core within said body between said layers and extending over substantially the entire width of the body, at least one profiled metal sheet disposed between a respective one of said layers and said core, said profiled metal sheet having a U-shaped recess opening away from said core and having a bottom defined by a back portion of said profiled sheet, said profiled sheet further comprising a pair of lateral flanges spaced from said back of said profiled sheet, said back of said profiled sheet bearing against said core and said flanges overhanging said core to define spaces along opposite edges of said core between said core and said flanges, and respective viscous-elastic strips received in said spaces for damping vibration of said ski.

2. The ski defined in claim 1 wherein a respective profiled sheet is provided between each of said layers of said core and each such profiled sheet has a back bearing against said core and flanges defining said spaces along opposite edges of said core between said core and the respective flanges, such viscous-elastic strips being received in the spaces of both of said profiled sheets.

3. The ski defined in claim 1 or claim 2 wherein said strips bridge between said flanges and said core.

4. The ski defined in claim 1 or claim 2 wherein said strips are of the same width as the respective flanges.

5. The ski defined in claim 1 or claim 2 wherein said spaces open freely laterally of the ski and the edges of said strips are laterally unconfined.

6. The ski defined in claim 1 or claim 2 wherein said strips have thicknesses equal substantially to the depth of the recess of the respective sheet.

7. The ski defined in claim 1 or claim 2, further comprising a solid material filling each of said recesses.

8. The ski defined in claim 7 wherein said solid material is a reinforced plastic.

9. The ski defined in claim 8 wherein the reinforced plastic is a plastic reinforced with glass rovings.

10. The ski defined in claim 8 wherein said solid material is a sheet having a thickness equal to the depth of the respective recess.

* * * * *